US007312780B2

(12) United States Patent
Olson et al.

(10) Patent No.: US 7,312,780 B2
(45) Date of Patent: Dec. 25, 2007

(54) FLUORESCENT LAMP DRIVER SYSTEM

(75) Inventors: Scot Olson, Scottsdale, AZ (US); Bruce Pitman, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 700 days.

(21) Appl. No.: 10/788,895

(22) Filed: Feb. 27, 2004

(65) Prior Publication Data

US 2005/0190167 A1 Sep. 1, 2005

(51) Int. Cl.
*G09G 3/36* (2006.01)

(52) U.S. Cl. ..... 345/102; 345/211; 345/212; 345/213; 345/204; 345/690; 315/291; 315/294; 315/295; 315/300

(58) Field of Classification Search ..... 345/102, 345/211–213, 204, 690
See application file for complete search history.

(56) References Cited

U.S. PATENT DOCUMENTS 4,959,594 A 9/1990 Ruby
4,998,045 A 3/1991 Ruby
5,027,034 A 6/1991 Ruby et al.
5,612,593 A 3/1997 Olson
5,754,013 A * 5/1998 Praiswater ..... 315/307
5,894,394 A * 4/1999 Baba et al. ..... 361/87
6,118,415 A 9/2000 Olson
6,222,709 B1 * 4/2001 Baba ..... 361/18
6,947,024 B2 * 9/2005 Lee et al. ..... 345/102

* cited by examiner

*Primary Examiner*—Richard Hjerpe
*Assistant Examiner*—Jennifer T Nguyen
(74) *Attorney, Agent, or Firm*—Ingrassia Fisher & Lorenz

(57) ABSTRACT

A lamp driver system is provided that facilitates improved efficiency and brightness control for an optical display system. The lamp driver system provides this improved efficiency and brightness control through the precise control of the plasma in the lamp. The lamp driver system excites the electrons in the plasma such that their obtained velocity is optimized to increase the probability of collision with the mercury atoms in the lamp. Collisions with mercury atoms release ultra-violet photons, which in turn excites the phosphor coating in the lamp. The resulting relaxation of the phosphor atoms releases photons in the visible spectrum, thus providing light with the required frequency components to illuminate the display.

15 Claims, 5 Drawing Sheets

FLUORESCENT LAMP DRIVER SYSTEM

FIELD OF THE INVENTION

This invention generally relates to optical displays, and more specifically applies to lamp drivers in optical displays.

BACKGROUND OF THE INVENTION

Various types of optical displays are commonly used in a wide variety of applications. Included among these various types of optical displays are liquid crystal displays (LCDs) such as Active Matrix LCDs (AMLCDs). LCDs typically use a passive or active matrix display grid to form an image on the display surface. The luminance of the LCD is provided by backlight lamp. One of the attractive characteristics of many LCD displays is the flexibility of configuring a system with the particular features needed for a specific application.

One important performance parameter in certain LCD displays is the range of luminance that can be provided by the LCD display, commonly referred to as the dimming range. In many applications it is critical that a display make information clearly visible in a wide variety of ambient light conditions. For example, a display used in an avionics control system will need to display information to the pilot under lighting conditions that can range from near total blackness to the extreme glare created by facing directly into daytime sunlight. Such a display must have a high maximum dimming ratio, where the dimming ratio is the ratio of the display luminance at highest brightness to the display luminance at its lowest setting. Without a sufficiently high dimming ratio, a viewer of the display may be unable to easily read information from the display in high ambient light conditions, low ambient light conditions, or both. In some applications, the required maximum dimming ratio may be as little as 100:1. In other applications, a maximum dimming ratio of 20,000:1 or greater may be required to effectively display information in its expected range of ambient conditions. Thus, in many applications the display must be able to accurately and clearly display information through a wide dimming range, with the ability to precisely control the amount of dimming.

LCD and other types of optical displays use a fluorescent lamp as a light source to illuminate the display. The lamp is driven by a lamp driver circuit that powers the lamp and controls the lamp output. One way to provide a wide dimming range is for the lamp driver circuit to drive the lamp at different luminance levels. Unfortunately, it can be difficult for a lamp driver circuit to accurately drive the fluorescent lamp over the entire range of needed different luminance levels without experiencing performance difficulties such as low efficiency and uneven luminous output.

For example, in a lamp driver that drives a fluorescent lamp flicker at low luminance levels can be a problem. Specifically, during low luminance operation of the fluorescent lamp conditions in the plasma can exist such that for a section of plasma longitudinal e-fields and the mean free path of electrons in a section of discharge correspond to electrons with the exact kinetic energy required to transition mercury ions to a higher energy state. Electrons in the plasma section thus go from elastic collisions to inelastic collisions with the mercury ions causing the plasma column to appear as sudden negative impedance to the fluorescent lamp driver. This drastic perturbation causes the fluorescent lamp driver to adjust itself to the radical load change, and the plasma section immediately reverts back to elastic collisions between electrons and mercury atoms because of changes in the longitudinal e-fields due to driver adjustment, leading to oscillations between the two states. These oscillations will be perceived as subtle flickering in the luminous flux coming from the lamp and may be unacceptable in high end avionics applications.

Thus, what is needed is an improved lamp driver system that provides a wide luminance range and precise brightness control while providing good efficiency.

BRIEF SUMMARY OF THE INVENTION

The present invention provides a lamp driver system that facilitates improved efficiency and brightness control for an optical display system. The lamp driver system provides this improved efficiency and brightness control through the precise control of the plasma in the lamp. The lamp driver system excites the electrons in the plasma such that their obtained velocity is optimized to increase the probability of collision with the mercury atoms in the lamp. Collisions with mercury atoms release ultra-violet photons, which in turn excites the phosphor coating in the lamp. The resulting relaxation of the phosphor atoms releases photons in the visible spectrum, thus providing light with the required frequency components to illuminate the display.

Without precise control of the plasma in the fluorescent lamp, electrons in the gas can be over-driven, resulting in a decreased probability of collision with mercury atoms and an increased probability of collision with other atomic species in the lamp (generally a noble gas such as Argon). Excessive collisions with argon atoms produce photons in the infrared light region having much less energy than the ultraviolet photons produced by mercury. This infrared light is unusable in many applications and thus represents an inefficient waste of power in the system. To provide precise control of the plasma in the lamp, the lamp driver system includes a power recovery and control circuit, and a fast logarithmic amplifier in an optical feedback path.

The power recovery and control circuit controls the e-field strength in the lamp to prevent inelastic collisions of the electrons with the mercury atoms. The power recovery and control circuit does this by limiting the voltage applied at the terminals of the lamp at low luminance operations and circulating excess energy back into the power source.

The fast logarithmic amplifier provides high gain at low luminance levels and exponentially decreasing gain at higher luminance levels. As such, the fast logarithmic amplifier provides high gain in the optical feedback loop when the luminous flux from the lamp is first detected by the circuit, with the gain quickly dropping as the plasma builds in the lamp. This action helps prevent e-field strength from becoming too excessive in the plasma and thus promotes plasma and system stability.

BRIEF DESCRIPTION OF DRAWINGS

The preferred exemplary embodiment of the present invention will hereinafter be described in conjunction with the appended drawings, where like designations denote like elements, and.

DETAILED DESCRIPTION OF THE INVENTION

The present invention provides a lamp driver system that facilitates improved efficiency and brightness control for a display system. The lamp driver system provides this improved efficiency and brightness control through the precise control of the plasma in the lamp. The lamp driver system excites the electrons in the plasma such that their obtained velocity is optimized to increase the probability of collision with the mercury atoms in the lamp. Collisions with mercury atoms release ultra-violet photons, which in turn excites the phosphor coating the walls of the lamp. The resulting relaxation of the phosphor atoms releases photons in the visible spectrum, providing a useable light source.

Without precise control of the plasma in the lamp, electrons in the gas can be over-driven, resulting in a decreased probability of collision with mercury atoms and an increased probability of collisions with argon atoms in the lamp. Excessive collisions with argon atoms produce photons in the infrared light region that have much less energy then the ultra-violet photons produced by mercury. This infrared light is unusable in many applications and thus represents an inefficient waste of power in the system.

Figure 1:
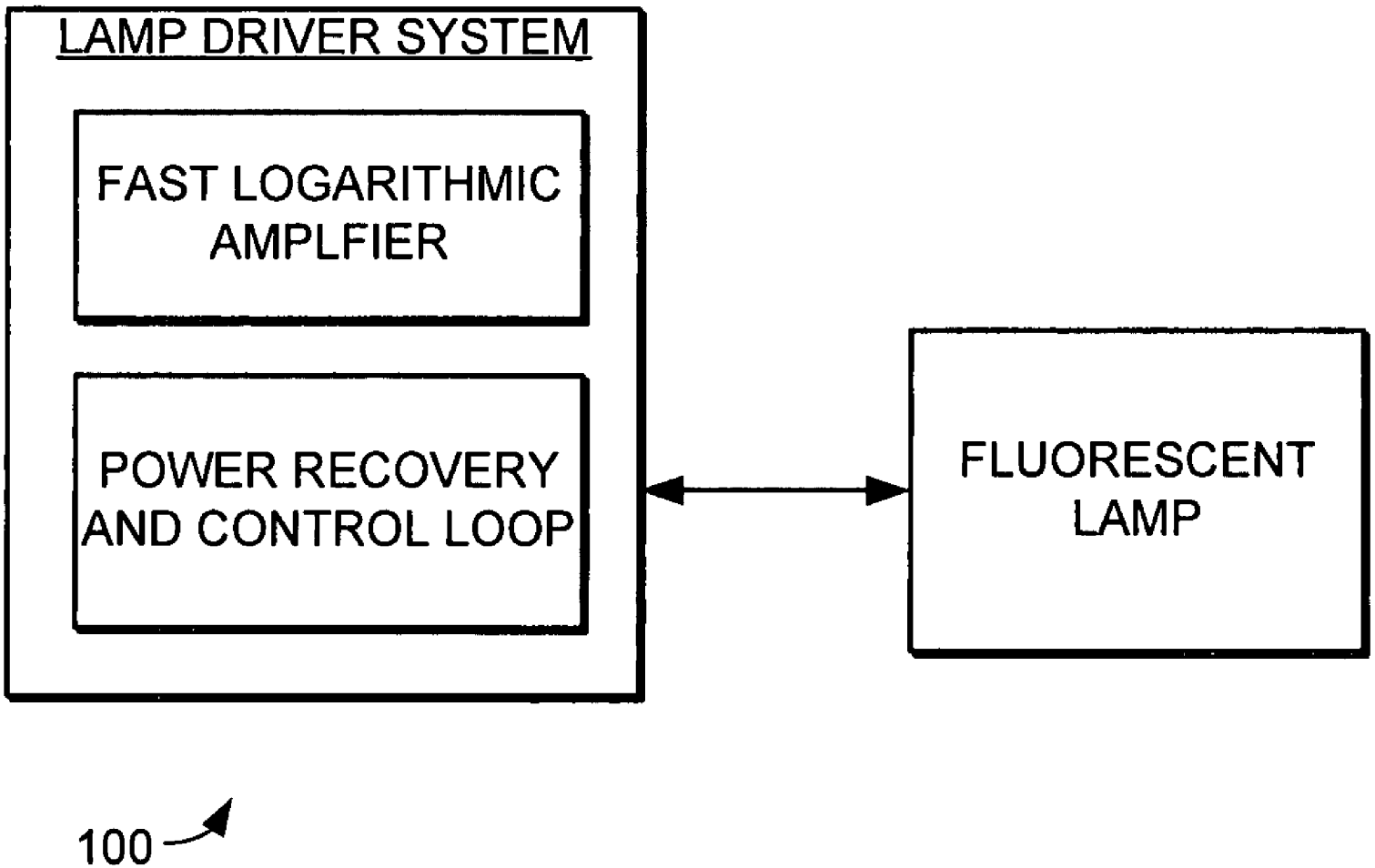
FIG. 1 is a schematic view of an exemplary embodiment lamp driver system.

Turning now to FIG. 1, a schematic view of a lamp driver system 100 is illustrated. The lamp driver system 100 includes a power recovery and control circuit and a fast logarithmic amplifier. The power recovery and control circuit controls e-field strength in the lamp to prevent inelastic collisions of electrons with the mercury atoms. The power recovery and control circuit does this by limiting the voltage applied at the terminals of the lamp and by circulating excess energy back into the power source. The fast logarithmic amplifier provides high gain at low luminance levels and exponentially decreasing gain at higher luminance levels. By providing high gain at low luminance levels, and lower gain at high luminance levels, the fast logarithmic amplifier facilitates precise control of the plasma by the lamp driver system 100. Specifically, the lamp driver system 100 is able to excite the electrons in the plasma such that their mean obtained velocity is optimized to increase the probability of collision with the mercury atoms in the lamp. This increased probability of collisions with mercury increases the efficiency of the lamp driver system 100 by reducing the wasted power resulting from collisions with argon atoms.

The lamp driver system 100 is designed to efficiently drive a fluorescent lamp. Fluorescent lamps come in a variety of shapes and configurations, including channeled flat lamps of various shapes and sizes, and tubular lamps, including serpentine tubular lamps. The lamps are generally filled with a small quantity of mercury and a low-pressure gas such as argon. The inner walls of the lamp are coated with a fluorescent material such as phosphor, and the ends of the tube are sealed around a pair of cathodes. Application of a voltage to the cathodes causes plasma to form along the axis of the lamp and current flowing in the plasma excites ionized mercury atoms in the plasma to higher energy, promoting a source of ultra-violet photons which in turn excite the atoms of the phosphor coating. The resulting relaxation of the exited phosphor atoms releases photons in the visible spectrum with a wavelength corresponding to the type of phosphor used in the fluorescent coating.

The lamp driver system 100 controls the plasma in the fluorescent lamp with precision, rendering the luminous flux output from the lamp a superior light source that can be used in a variety of demanding applications, such as for illuminating active matrix liquid crystal displays (AMLCDs) used in cockpit avionics. As stated above, this is accomplished by exciting the electrons in the plasma such that their mean obtained velocity is optimized to increase the probability of collision with the mercury atoms in the lamp. This increased probability of collisions with mercury increases the efficiency of the lamp driver system 100 by reducing the wasted power resulting from collisions with argon atoms. Without precise control of the plasma in the lamp, the electrons in the gas can be easily over-driven, resulting in a decreased probability of collision with mercury atoms and an increased probability of collision with the argon atoms in lamp. Collision with argon atoms produces photons at 810 nm, and 840 nm, in the infrared light region. These infrared photons have much less energy than the ultra-violet photons produced by mercury. This infrared light is unusable by the active LCD displays used in demanding avionics applications and thus represents an inefficient waste of power in the system. Additionally, the infrared light is within the operating range of typical night vision equipment. For applications requiring the display to be compatible with night vision equipment, expensive optical infrared filtering will be required to remove the undesirable infrared light. The precise control of the plasma provided by the lamp driver system 100 reduces these collisions with the argon in the lamp, and thus increases the efficiency of the lamp system and reduces the amount of unwanted infrared light, reducing the need for expensive filtering.

The fast logarithmic amplifier of lamp driver system 100 provides a high gain at low luminance levels and exponentially decreasing gain at higher luminance levels. The logarithmic amplifier helps control loop stability when higher levels or luminance are required. The fast logarithmic amplifier improves the performance of the lamp at low levels by providing high gain in the optical feedback loop when the luminous flux from the lamp is first detected by the circuit, and then quickly dropping the loop gain as the plasma builds in the lamp. This action helps prevent e-field strength from becoming too excessive in the plasma and thus promotes plasma and system stability.

Figure 2:
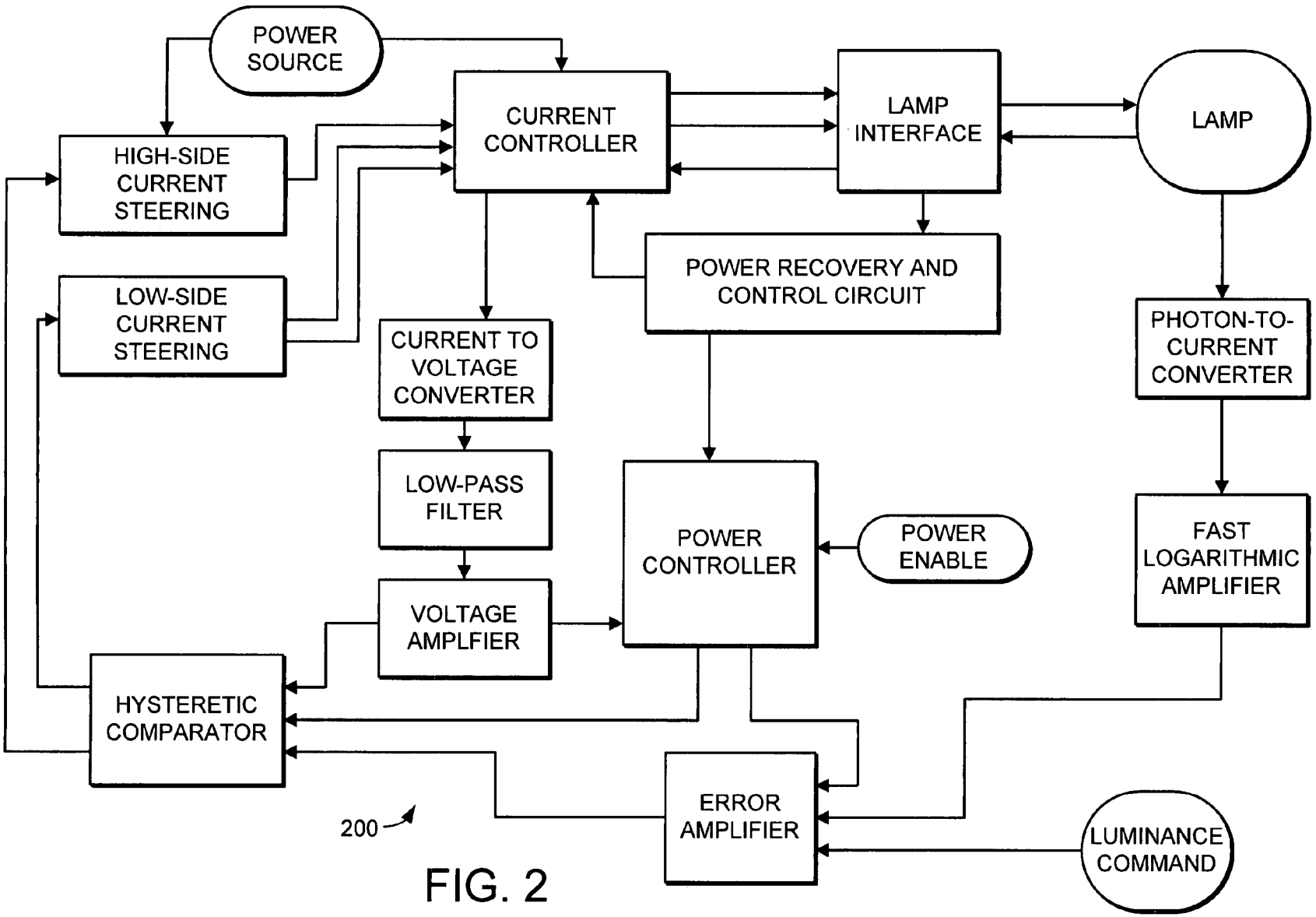
FIG. 2 is a schematic view of an exemplary embodiment lamp driver system.

FIG. 2 illustrates a schematic view of an exemplary embodiment lamp driver system. The lamp driver system 200 is one example of a lamp system topology that can be used with a fast logarithmic amplifier to provide precise plasma control and increase the probability of collision with mercury atoms in the lamp.

In general, the lamp driver system 200 is arranged in three loops that deliver power to a fluorescent lamp in a resonant manner. These three loops include a current control loop, a power recovery loop and an optical feedback loop. To implement these three loops, the lamp driver system 200 includes high-side current steering, a low-side current steering, a hysteretic comparator, a current controller, a current-to-voltage converter, a low pass-filter, a voltage amplifier, a lamp interface, a power recovery and control circuit, a power controller, an error amplifier, a photon-to-current converter, and a fast logarithmic amplifier. The lamp driver system 200 receives power from a power source, receives luminance control signals from a luminance command, and from this input drives a fluorescent lamp.

The current control loop precisely regulates the flow of current through the plasma in the fluorescent lamp for any commanded luminance required from the lamp. The current control loop includes the high-side steering, the low side steering, the current controller, the current-to-voltage converter, the low pass filter, the voltage amplifier and the hysteretic comparator. The current controller preferably includes wave shaping elements used to tune the fluorescent lamp driver to a variety of different lamps. The high-side current steering is controlled by the hysteretic comparator and maintains the level of current necessary for the given light output by periodically refreshing the current controller with power from the power supply. The low-side current steering is driven from the hysteretic comparator and determines the path excitation flows in the current controller. The current-to-voltage converter, low-pass filter and voltage amplifier work together to provide a signal mirroring plasma current dynamics in the lamp and provides a representation of the signal to the hysteretic comparator. Specifically, the current-to-voltage converter measures the current flowing in the current controller. The low-pass filter removes any switching spikes incurred in the sampled current voltage by current control operation. The voltage amplifier conditions the signal mirroring plasma current dynamics and presents it to an input of the hysteretic comparator.

The power source is preferably a tightly regulated input supply. The lamp driver system 200 can regulate power from a widely ranging input supply, but for avionics applications requiring large dimming ratios, a tightly regulated power source provides optimal results.

The lamp driver system 200 is designed to prevent the electrons in the plasma from oscillating between elastic collisions and inelastic collisions that can be perceived as flickering in the luminous flux. The power recovery loop functions to prevent inelastic collisions of the electrons with the mercury atoms. The power recovery loop includes the lamp interface, power recovery and control circuit, current controller and power controller. The power recovery loop prevents inelastic collisions by controlling the e-field strength in the lamp. Specifically, the power recovery element does this by limiting the voltage at the terminals of the fluorescent lamp during low luminance operation.

The voltage presented to the lamp terminals directly corresponds to the longitudinal e-field strength in the lamp. This e-field strength in the lamp, under certain drive conditions, can impart a corresponding energy to the majority of the electrons in the plasma such that when they collide with mercury atoms, all of their kinetic energy is used to excite the mercury atoms. This dynamic can result in unstable, oscillating plasma. With the power recovery and control circuit, the voltage at the terminals is limited and excess energy is circulated back to the power source, providing stable plasma and improving system efficiency.

The power recovery and control circuit also preferably includes an over-current limiter. The over-current limiter circuit limits current in the current control loop. Specifically, the over current limiter shuts down the power controller if an over-current limit in the power feedback is exceeded. This protects the lamp driver circuitry if a lamp breaks or if a lamp is disconnected from the driver.

The optical feedback loop measures the luminance flux output coming from the lamp and this signal is used by the rest of the lamp driver to hold the lamp output to the commanded input level. The optical feedback loop includes the photon-to-current converter, the fast logarithmic amplifier and the error amplifier. The optical feedback loop measures the luminous flux coming from the lamp and outputs a proportional current. This proportional current is converted to a voltage by the fast logarithmic amplifier. The output of the fast logarithmic amplifier is summed with a luminance command signal that indicates a desired lamp output level. The summed signal drives the negative input on the error amplifier. The positive input terminal of the error amplifier is generally held at a DC level, such as ground. The error amplifier thus drives the lamp output to equal the level specified by the luminance command signal.

The error amplifier output is compared with the voltage output of the current control loop at the hysteretic converter. This causes the current control loop circuitry to drive the plasma in the fluorescent lamp. Specifically, the current control loop is driven to generate an intensity of fluorescent light that causes the signal out of the fast logarithmic amplifier to negate the luminance commanded signal. Hysteretic comparator behavior thus couples the current control loop with the optical feedback loop. The interplay between the control loop and the optical feedback loop determine the physical processes occurring in the lamp plasma. Additionally, because of the fast logarithmic amplifier in the optical loop, the luminance level output commanded from the fluorescent lamp will be logarithmically increasing for linearly increasing luminance command inputs. This corresponds to the way the human eye perceives changes in brightness.

Also included in the lamp driver system 200 is the power controller. The power controller receives input from the power recovery and control circuit, the voltage amplifier in the current control circuit, and a power enable signal. The power controller generates two output signals. One signal drives an input to the hysteretic comparator, and the other signal drives an input to the error amplifier. These signals are used to limit the overall power that can be delivered to the fluorescent lamp, and thus protects the lamp and drive circuitry in the event of component failure. The power enable signal provides the ability to prevent energy transfer to the lamp until the system controlling the lamp driver and the rest of the display is ready.

Figure 3:
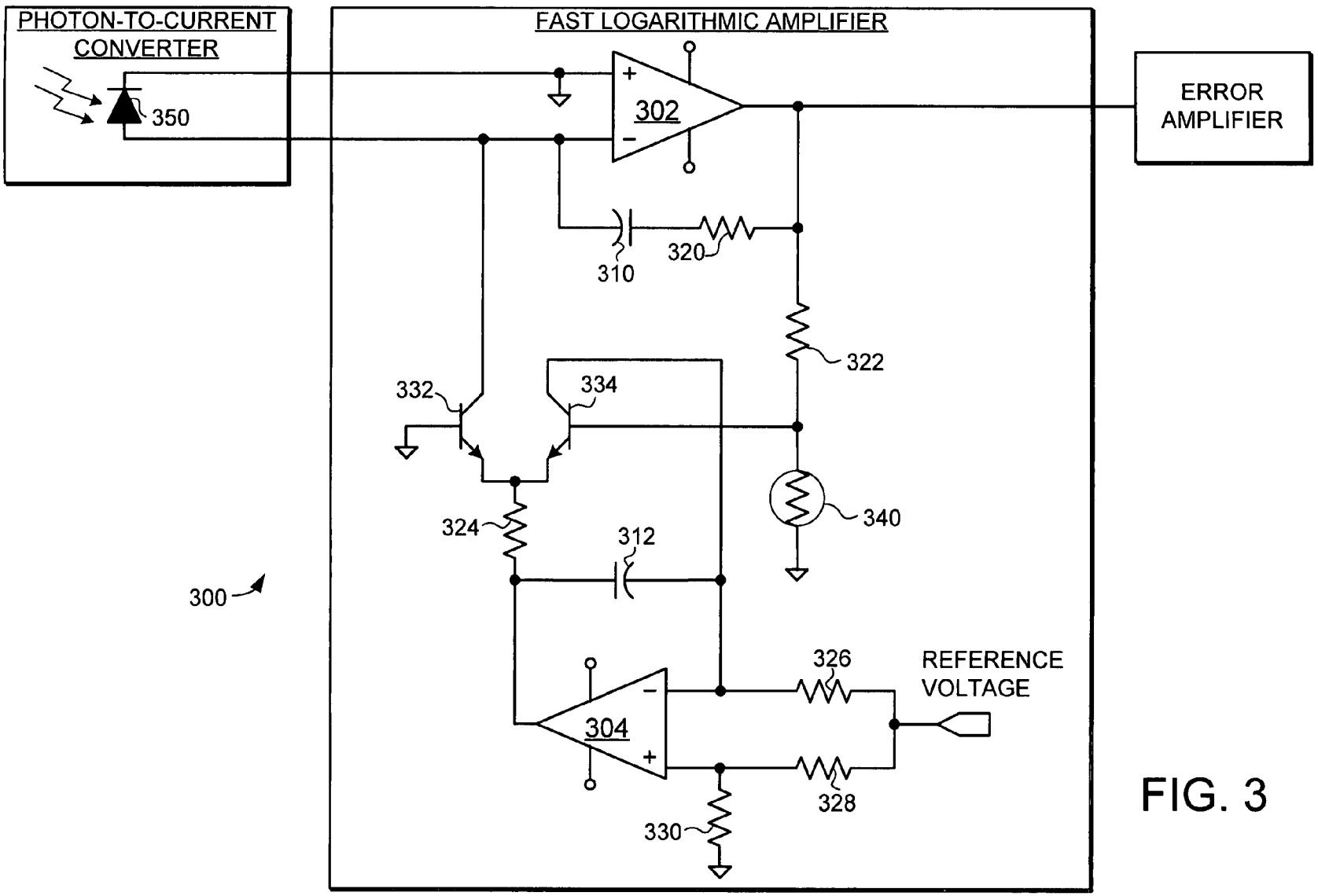
FIG. 3 is a schematic view of an exemplary embodiment fast logarithmic amplifier.

Turning now to FIG. 3, an exemplary fast logarithmic amplifier 300 is illustrated. Fast logarithmic amplifier 300 is an example of the type of log amp that can be used in the lamp driver system, but other types could also be used. The fast log amplifier 300 includes op-amps 302 and 304, capacitors 310 and 320, resistors 320, 322, 324, 326, 328 and 330, temperature compensated resistor 340, and transistors 332 and 334. The photon-to-current converter includes a photo-diode 350. The photo-diode 350 receives light from the lamp and generates a current that is proportional the amount of light received. That current is amplified by the fast log amplifier 300 and the resulting amplified voltage signal is passed to the error amplifier.

In log amplifier 300, the op amp 304 is set up with negative feedback and the positive input tied to voltage determined by the reference voltage input and the voltage divider comprising resistors 328 and 330. The negative feedback results in a near constant voltage at the negative input of op amp 304 and a corresponding constant collector current through the collector of transistor 334. The result is that log amp 300 has an output voltage $V_{out}$ substantially defined by:

$$V_{out} = -\ln\left[\frac{I_D}{I_C}\right] \tag{1.}$$

Where $I_D$ is the current through the photo-diode 350 and $I_C$ is the collector current in transistor 334. Thus, the output voltage is proportional to the negative natural log of the photo-diode current divided by the current in the collector. This results in a high gain at low luminance levels and exponentially decreasing gain at higher luminance levels. As such, the fast logarithmic amplifier provides high gain in the optical feedback loop when the luminous flux from the lamp is first detected by the circuit, with the gain quickly dropping as the plasma builds in the lamp. This action helps prevent e-field strength from becoming too excessive in the plasma and thus promotes plasma and system stability.

It is important to note that the transistors 332 and 334 are preferably formed on the same die to assure matching characteristics and operating temperatures. Additionally, the temperature compensating resistor 340 is preferably selected to substantially cancel out the effects of temperature on the transistors 332 and 334. This results in $V_{out}$ being substantially temperature independent, as illustrated in equation 1.

In log amplifier 300, the op amp 302 is set up with negative feedback and its positive input tied to ground. This results in the op amp 302 driving the negative input such that there are zero volts on the photo-diode 350. This helps compensate for temperature induced differences in the photo-diode 350 that would otherwise occur as a result of its proximity to the lamp.

Figure 4:
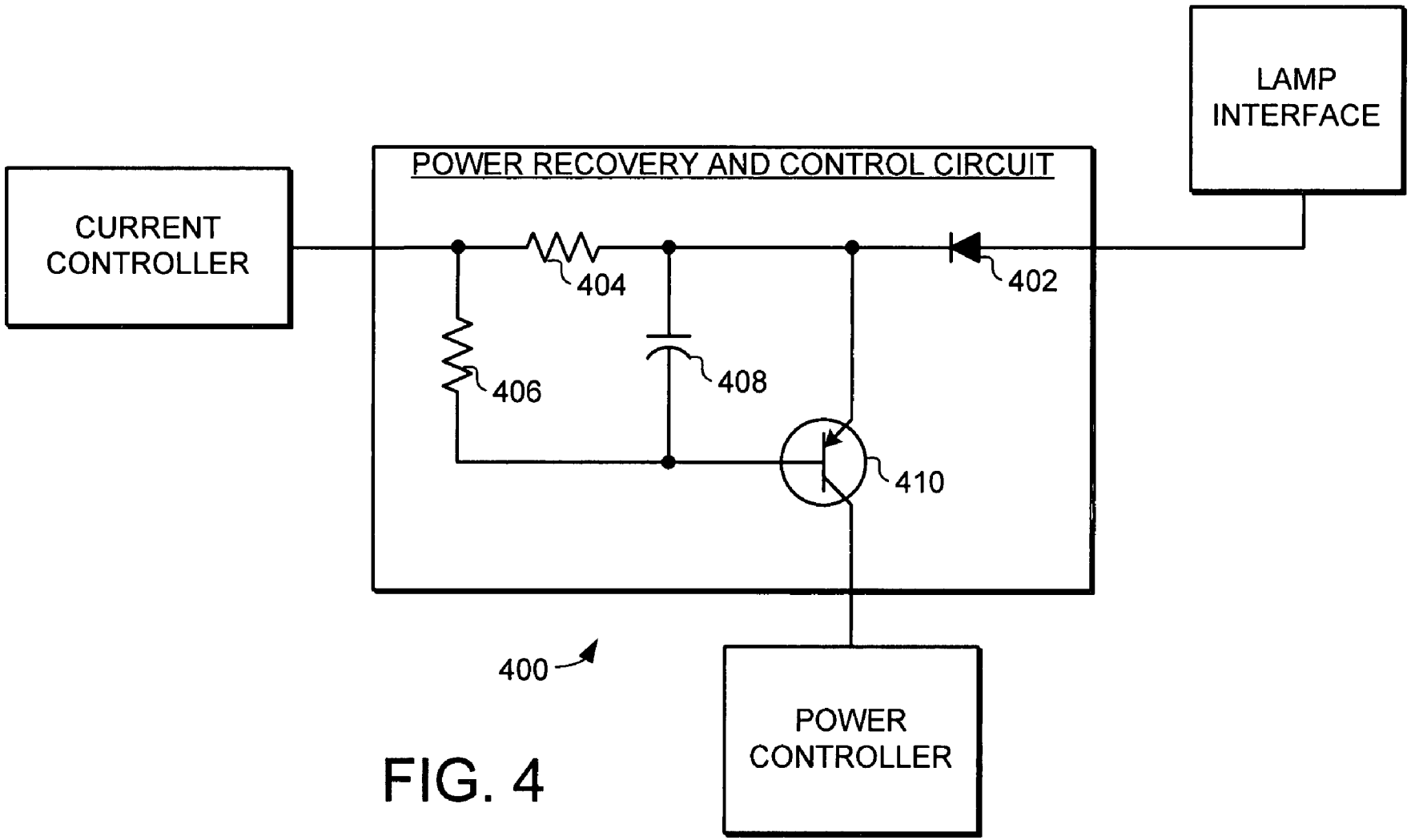
FIG. 4 is a schematic view of an exemplary embodiment power recovery and control circuit.

Turning now to FIG. 4, an exemplary power recovery and control circuit 400 is illustrated schematically. The power recovery and control circuit 400 is exemplary of the type of device that can be used in a power recovery loop in the fluorescent lamp driver. The power recovery and control circuit 400 facilitates control of the e-field strength in the lamp to help prevent inelastic collisions of the electrons with the mercury atoms. The power recovery and control circuit 400 does this by limiting the voltage applied at the terminals of the lamp at low luminance operations and circulating excess energy back into the power source. Additionally, the power recovery and control circuit 400 limits the current that is fed back to the power source. Specifically, the over current limiter shuts down the power controller if an over-current limit in the power feedback is exceeded.

The exemplary power recovery and control circuit 400 includes a diode 402, resistors 404 and 406, capacitor 408 and transistor 410. The power recovery and control circuit 400 is coupled to the lamp through the lamp interface and coupled to the power supply through the current controller. Preferably, the circuit 400 is coupled to the lamp interface through a transformer that is used to interface to the lamp at a point that where the desirable voltage at the interface is close to the power supply voltage. When the voltage at the lamp interface rises above this desirable level, the diode 402 turns on and current begins to flow between the lamp interface and current controller. This current comprises excess power that can be fed back into the power supply to improve lamp efficiency. Furthermore, by limiting voltage at the lamp interface, the e-field strength in the lamp can be more accurately controlled.

If the voltage at the lamp interface continues to rise above desirable levels, the current flowing through diode 402 will continue to rise. Eventually enough current will flow across diode 402 to turn transistor 410 on. Specifically, when the current flowing through diode 402 reaches certain level, the voltage drop created across resistor 404 will create a base-emitter voltage difference large enough to turn transistor 410 on. This pulls the input to the power controller to the high voltage at the interface, where it causes the power controller to shut off power to the driver circuit. Thus, when the voltage at the lamp interface has risen substantially above desirable levels, the transistor 410 will turn off the driver, avoiding damage to the driver and lamp circuit.

The resistor 406 and capacitor 408 provide an RC circuit that controls the switching of the transistor 410. They would generally be selected to ensure that the power controller can be switched off fast enough to avoid damage to the driver, but also to avoid unwanted switches that could occur as a result of relatively short voltage spikes. The resistor 404 would be selected to ensure that the transistor 410 only switches on when currents above an undesirable threshold exist. As an example, the resistor 404 can be selected to ensure that the lamp driver is turned off when the lamp fails or is removed.

Taken together, the power recovery and control circuit 400 serves to reduce unwanted voltage fluctuations at the lamp interface and feed back excess power to the power supply. Again, this facilitates more accurate control of the e-field strength in the lamp and improves the efficiency of the system.

Figure 5:
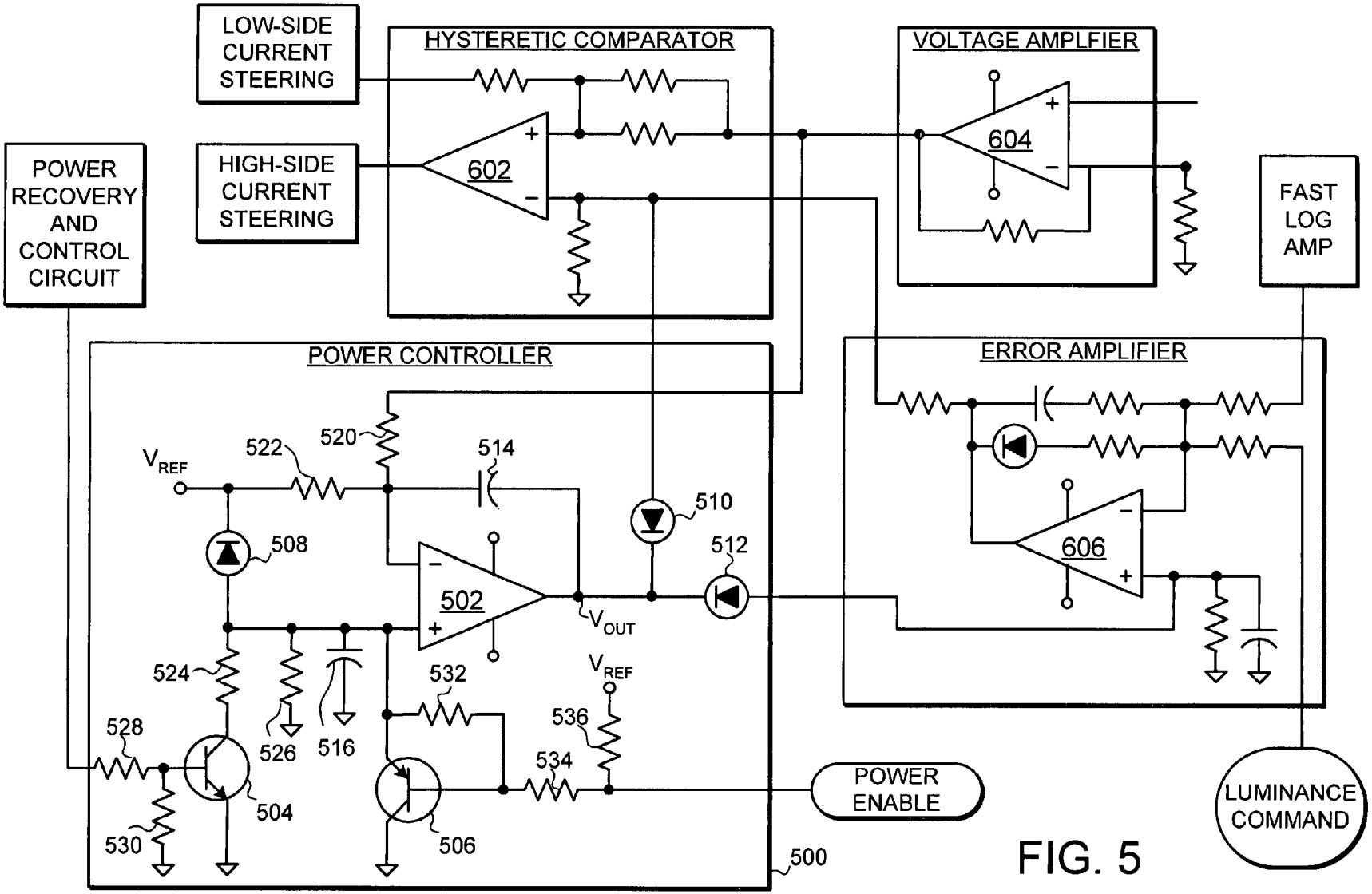
FIG. 5 is a schematic view of an exemplary embodiment power controller circuit.

Turning now to FIG. 5, an exemplary power controller 500 is illustrated schematically. The power controller 500 is exemplary of one type of device that can be used as a power controller in a fluorescent lamp driver circuit. Of course, other suitable implementations of a power controller could also be used. As described with reference to FIG. 2, the power controller 500 is coupled to the error amplifier, the voltage amplifier, the hysteretic comparator and power recovery and control circuit. The power controller 500 includes op amp 502, transistors 504 and 506, diodes 508, 510 and 512, capacitors 514 and 516, and resistors 520, 522, 524, 526, 528, 530, 532, 534 and 536. Also illustrated in FIG. 5 are some elements of an exemplary error amplifier, voltage amplifier (and part of current to voltage converter) and hysteretic comparator. These elements will be used to explain the exemplary operation of the power controller 500, and are also only examples of the types of devices that can be used in the lamp driver system.

In general, the power controller 500 receives an enable signal, a signal from power recovery and control circuit, and a signal from the voltage amplifier. In response to these signals, the power controller 500 generates an output signal $V_{OUT}$. The output signal $V_{OUT}$ drives an input to the error amplifier and the hysteretic comparator. The output signal $V_{OUT}$ is used to turn off the lamp driver and is also used to limit the overall power delivered to the fluorescent lamp, thus protecting the lamp and drive circuitry in the event of component failure.

The power enable signal is used to turn the lamp driver on and off. During normal operation, the power enable signal is high, and the op-amp output $V_{OUT}$ is driven to the high rail voltage by reference voltage $V_{REF}$. To turn off the driver, the power enable signal is taken low. With the power enable signal low, the transistor 506 will be on, and the positive input of op-amp 502 will be near ground and less than negative input terminal of op-amp 502. This results in the output $V_{OUT}$ of op-amp 502 driving to the negative rail. Through diode 510, this pulls the negative input terminal of hysteretic comparator op-amp 602 low. Likewise, through diode 512 this pulls the positive input terminal of the error amplifier op amp 606 low. These actions effectively disable the lamp driver and the fluorescent lamp will thus be off.

During operation of the lamp driver, the power controller 500 also functions to limit the overall power that can be delivered to the lamp and protects the lamp and drive circuit against damage in the event of component failure. Specifically, the power controller 500 receives a signal from the voltage amplifier that is a representation of the current dynamics in the lamp, and reacts to reduce power to the lamp if the current rises too high. The power controller 500 also receives a signal from the power recovery and control unit, and turns off the power to the lamp when the power recovery and control unit signal indicates that too high a voltage exists across the lamp.

Specifically, during operation of the lamp driver, the voltage at the output of the voltage amplifier op-amp 604 will rise proportionally with the current in the lamp. The reference voltage $V_{REF}$ and resistors 520 and 522 are selected to keep the negative input terminal of op-amp 502 higher than the positive input terminal until the current in the lamp rises above a safe level. When the negative input terminal of the op-amp 502 is higher than the positive input terminal, the op-amp 502 output $V_{OUT}$ is driven to the positive voltage rail. With the op-amp 502 driven to the positive rail, the diodes 512 and 510 disconnect the op-amp 502 output from the error amplifier and hysteretic comparator, allowing the error amplifier and hysteretic comparator to operate normally as described with reference to FIG. 2.

If the current in the lamp rises above a predefined level, the output of the voltage amplifier op amp 604 will rise enough to cause voltage on the negative input terminal of op-amp 502 to attain the voltage level at the positive input terminal of op-amp 502. When the negative input terminal voltage of op amp 502 reaches the level of the positive input terminal, the op amp 502 begins to operate in a closedloop feedback manner. Because op-amp 502 is configured with negative feedback, it will drive its output to make the negative input terminal equal to the positive input terminal. Additionally, because the op-amp 502 functions as an integrator, and the positive input terminal voltage is not changing, the output of the op-amp 502 will decrease linearly.

The dropping voltage $V_{OUT}$ at the output of op-amp 502 will eventually cause diode 512 to turn on and clamp the input voltage to the error amplifier to the output voltage of the op-amp 502. Specifically, diode 512 turns on to clamp the positive input of the error amplifier. This causes the error amplifier to limit the current in the lamp, thus clamping the light output to a level set by the power limit. At the same time, diode 510 turns on clamps the negative input terminal of the hysteretic comparator, thus shutting down the lamp current.

When the current in the lamp drops to an acceptable level, the output of the voltage amplifier 604 will drop to a level that makes the negative input terminal of op-amp 502 drop below the positive input terminal. This causes the op-amp 502 to return to the positive rail output voltage and be disconnected from the error amplifier and hysteretic comparator by virtue of diodes 510 and 512. Thus, the power controller 500 utilizes feedback and temporarily adjusts the operation of the error amplifier and hysteretic comparator to limit or reduce current in the lamp.

The power controller 500 also protects the lamp from excessive voltage in the lamp by turning off the driver if the voltage rises above defined level. Specifically, the power controller 500 receives a signal from the power recovery and control circuit when voltage across the lamp is too high. As described above with the reference to FIG. 4 and an exemplary power recovery and control circuit, the power recovery and control circuit feeds back excess power to the power supply, and if the voltage at the lamp interface continues to rise above desirable levels the power recovery and control circuit will enable a signal to turn off the driver. In the embodiment illustrated in FIG. 5, that signal is passed to transistor 504 through the voltage divider comprising resistors 528 and 530.

When the signal from the power recovery and control circuit goes high enough to turn on transistor 504, this drives the output amplifier 502 to the negative rail. Action of diode 510 pulls the negative input terminal voltage of the hysteretic comparator op-amp 602 low. Likewise, action of diode 512 pulls the positive input terminal voltage of the error amplifier op-amp 606 low. These actions effectively disable the lamp driver and turn off the fluorescent lamp. The power controller 500 is preferably implemented to disable the lamp driver quickly, with an exponential transient response. This allows the lamp driver to be shut down quickly in the case of a lamp failure or removal, preventing damaging currents and over-voltages from the various lamp driver components.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

The invention claimed is:

1. A lamp driver device for driving a fluorescent lamp in an optical display, the lamp driver device comprising:

a logarithmic amplifier, the logarithmic amplifier having a relatively high gain at low luminance levels and a relatively low gain at high luminance levels, the logarithmic amplifier including an op amp coupled to a photo-diode, the op amp configured with negative feedback to drive a current such that substantially zero volts are across a photo-diode to compensate for temperature differences in the photo-diode; and a power recovery and control circuit, the power recover and control circuit coupled to a lamp interface and feeding back excess energy from the lamp interface to a power source, the logarithmic amplifier and power recovery and control circuit providing a precise control of plasma in the fluorescent lamp to reduce collisions with mercury atoms in the fluorescent lamp.

2. The lamp driver device of claim 1 wherein the power recovery and control circuit includes a current limiter, the current limiter disabling power in the lamp driver when the excess energy feeding back into the power source has a current above a selected value.

3. The lamp driver device of claim 1 wherein the logarithmic amplifier has an exponentially decreasing gain as luminance levels in the fluorescent lamp rise.

4. The lamp driver device of claim 1 wherein the logarithmic amplifier further includes a temperature compensating resistor selected to compensate the logarithmic amplifier for changes in temperature, and further includes a pair of matched transistors and wherein the temperature compensating resistor is selected to compensate for temperature in the pair of matched transistors.

5. The lamp driver device of claim 1 wherein the lamp driver device further comprises a power controller, the power controller receiving a signal proportional to current in the fluorescent lamp, the power controller limiting current in the fluorescent lamp when the current begins to exceed a predetermined level.

6. A lamp driver device for driving a fluorescent lamp in an optical display, the lamp driver device comprising:

a logarithmic amplifier, the logarithmic amplifier coupled to receive a lamp output measurement and amplify the lamp output measurement, the logarithmic amplifier having a relatively high gain at low luminance levels and a relatively low gain at high luminance levels to reduce e-field strength in the lamp at high luminance levels;

a power recovery and control circuit, the power recover and control circuit coupled to a lamp interface and a power source, the power recovery and control circuit feeding back energy from the lamp interface to the power source when a voltage at the lamp interface rises above a first level and disabling power to the driver when the voltage rises above a second level.

7. The lamp driver device of claim 6 wherein the lamp output measurement comprises a photo-diode measurement, and wherein the logarithmic amplifier further includes an op-amp with negative feedback, and wherein the op-amp with negative feedback is configured to drive a current such that substantially zero volts are across the photo-diode to compensate for temperature differences in the photo-diode.

8. The lamp driver device of claim 7 wherein the logarithmic amplifier further includes a pair of matched transistors and a temperature compensating resistor, with at least one of the pair matched transistors coupled to the op-amp input, and wherein the temperature compensating resistor is selected and configured to compensate for temperature in the pair of matched transistors.

9. The lamp driver device of claim 6 wherein the logarithmic amplifier has an exponentially decreasing gain as luminance levels rise.

10. A lamp driver device for driving a fluorescent lamp in an optical display, the lamp driver device comprising:

a lamp interface, the lamp interface coupled to the fluorescent lamp to provide power to the fluorescent lamp;

a power recovery and control loop, the power recover and control loop coupled to the lamp interface and feeding back excess energy from the lamp interface to a power source; and an optical feedback loop, the optical feedback loop including an photon-to-current converter, a logarithmic amplifier, an error amplifier and a hysteretic comparator, the photon-to-current converter measuring a luminance output from the fluorescent lamp and outputting a measured luminance output, the logarithmic amplifier coupled to the photon-to-current converter and amplifying the measured luminance output to generate a logarithmic amplifier output, the logarithmic amplifier having a relatively high gain at relatively low luminance levels and a relatively low gain at relatively high luminance levels, the error amplifier coupled to and receiving the logarithmic amplifier output, the error amplifier summing the logarithmic amplifier output to a luminance command signal and generating an error amplifier output, the hysteretic comparator comparing the error amplifier output to a signal mirroring plasma current dynamics in the lamp and driving the lamp to generate a luminance level where the logarithmic amplifier output corresponds to the luminance command level.

11. The lamp driver device of claim 10 wherein the lamp driver device further comprises a power controller receiving a signal proportional to current in the fluorescent lamp, the power controller coupled to the error amplifier to limit current in the fluorescent lamp when the signal proportional to the current in the fluorescent lamp indicates that current in the lamp is exceeding a predetermined level.

12. The lamp driver device of claim 11 wherein the power controller further receives a signal from the power recovery and control circuit, the power controller shutting down the error amplifier when the signal from the power recovery and control circuit indicates that the current in the fluorescent lamp exceeds a second predetermined level.

13. The lamp driver device of claim 10 wherein the photon-to-current converter comprises a photo-diode, and wherein the logarithmic amplifier further includes an op-amp with negative feedback, and wherein the op-amp with negative feedback is configured to drive a current such that substantially zero volts are across the photo-diode to compensate for temperature differences in the photo-diode.

14. The lamp driver device of claim 13 wherein the logarithmic amplifier further includes a pair of matched transistors and a temperature compensating resistor, with at least one of the pair matched transistors coupled to the op-amp input, and wherein the temperature compensating resistor is selected and configured to compensate for temperature in the pair of matched transistors.

15. The lamp driver device of claim 10 wherein the logarithmic amplifier has an exponentially decreasing gain as luminance levels rise.

* * * * *